US007322170B2

(12) United States Patent
Tomalesky et al.

(10) Patent No.: US 7,322,170 B2
(45) Date of Patent: Jan. 29, 2008

(54) APPARATUS AND METHOD OF STERILE FILLING OF CONTAINERS

(75) Inventors: Richard Tomalesky, Berrysville, VA (US); Lance Barland, Culpepper, VA (US); Mark C. Peastrel, High Poiont, NC (US); Joel C. Slazyk, Greensboro, NC (US); Douglas C. Logeman, Greensboro, NC (US)

(73) Assignee: Mediatech, Inc., Herndon, VA (US)

( * ) Notice: Subject to any disclaimer, the term of this patent is extended or adjusted under 35 U.S.C. 154(b) by 0 days.

(21) Appl. No.: 11/218,897

(22) Filed: Sep. 2, 2005

(65) Prior Publication Data

US 2006/0086065 A1 Apr. 27, 2006

Related U.S. Application Data

(60) Provisional application No. 60/606,818, filed on Sep. 2, 2004.

(51) Int. Cl.

| | |
|---|---|
| ***B65B 55/08*** | (2006.01) |
| ***B65B 43/40*** | (2006.01) |
| ***B65B 7/28*** | (2006.01) |
| ***B65B 57/00*** | (2006.01) |

(52) U.S. Cl. ..... 53/426; 53/468; 53/471; 53/53; 53/75; 53/167; 53/281; 53/381.4; 141/329; 141/92; 141/129; 141/168

(58) Field of Classification Search ..... 53/167, 53/426, 468, 281, 283, 268, 270, 271, 381.4, 53/53, 75, 109, 471, 490, 492, 110; 141/170, 141/329, 2, 11, 69, 85, 88–92, 129, 168, 172
See application file for complete search history.

(56) References Cited

U.S. PATENT DOCUMENTS 1,346,613 A * 7/1920 Taliaferro et al. ..... 53/281

(Continued)

*Primary Examiner*—Stephen F. Gerrity
(74) *Attorney, Agent, or Firm*—Gwendolyn R. Acker Wood; Eckert Seamans Cherin & Mellott, LLC

(57) ABSTRACT

An apparatus for the sterile filling of containers sterilizes the containers before supplying them, with their caps on, to a substantially airtight chamber for filling. A precision lead screw precisely positions each container under the appropriate capping/uncapping mechanism and the appropriate filling needle. Filling and capping of each container is individually controlled so that each container is filled with a precise amount of liquid, and each cap is applied with the proper torque. The minimized number of components of the system minimizes the potential openings through which unfiltered air may enter the apparatus. Keeping the containers capped except while they're actually being filled minimizes the opportunity for any bacteria or viruses to enter the container.

25 Claims, 7 Drawing Sheets

U.S. PATENT DOCUMENTS 2,529,199 A * 11/1950 Stover ..... 53/426
2,695,123 A * 11/1954 Suellentrop ..... 141/170
2,995,882 A * 8/1961 Barnby ..... 53/284.6
3,336,722 A * 8/1967 Van Der Winden ..... 53/426
3,405,499 A 10/1968 Dexter
3,405,500 A * 10/1968 Rupert ..... 53/471
3,527,017 A * 9/1970 Bott et al. ..... 53/500
3,564,805 A * 2/1971 Mumford ..... 53/420
3,775,829 A 12/1973 Rice
3,870,175 A 3/1975 Dilanni
3,987,535 A 10/1976 Brown
4,004,620 A 1/1977 Rosen
4,283,901 A * 8/1981 Schieser et al. ..... 53/75
4,401,141 A 8/1983 Rosen et al.
4,535,583 A 8/1985 Tanaka et al.
4,607,196 A 8/1986 Abrahams
4,701,612 A 10/1987 Sturgill
4,746,212 A 5/1988 Sudo et al.
4,761,936 A 8/1988 Suzuki et al.
4,804,024 A 2/1989 Arnemann
4,926,717 A 5/1990 Gomes
4,979,350 A * 12/1990 Arnemann ..... 53/331.5
5,016,688 A 5/1991 Suzuki et al.
5,129,212 A 7/1992 Duffey et al.
5,425,402 A 6/1995 Pringle
6,186,193 B1 2/2001 Phullen et al.
6,205,743 B1 * 3/2001 Castellari ..... 53/53
6,256,964 B1 * 7/2001 Drevfors ..... 53/426
6,530,402 B2 3/2003 Suzuki et al.
6,586,172 B1 7/2003 Gunn et al.
6,729,366 B2 5/2004 Tanaka et al.
6,796,108 B2 * 9/2004 Jorba Ribes et al. ..... 53/507
2002/0000259 A1 1/2002 Suzuki et al.
2002/0139436 A1 10/2002 Rosen et al.
2002/0178689 A1 12/2002 Nervo
2003/0041560 A1 3/2003 Kemnitz
2004/0088951 A1 5/2004 Baldwin et al.

* cited by examiner

APPARATUS AND METHOD OF STERILE FILLING OF CONTAINERS

CROSS REFERENCE TO RELATED APPLICATION

This application claims the benefit of U.S. provisional patent application No. 60/606,818, filed Sep. 2, 2004, entitled "Apparatus and Method of Sterile Filling of Containers."

BACKGROUND OF THE INVENTION

1. Field of the Invention

The present invention relates to the automated filling of containers. More specifically, the invention provides apparatus and method for the sterile filling of capped containers.

2. Description of the Related Art

Over numerous methods of filling container have been proposed, none provides the degree of sterility along with the flexibility and ease of changing from one size and shape of container to another as the present invention.

An example of a container filling system is disclosed in U.S. Patent Application No. 2004/0088951 A1. This patent discloses a syringe handling, labeling, filling, and capping system. The system begins with multiple syringes connected to a belt. The belt is separable into individual portions with sufficient space for labeling the individual portions of the belt. The plunger and cap have previously been applied to the syringe in a clean room. The belt with syringes is sterilized by gamma rays. The spacing of the syringes on the belt corresponds to the spacing of hold locations on a holder for holding the syringes in place while operations are being performed. With the syringe being held in the holder, the cap is removed, the syringe filled, and the cap replaced. The cap retainer is moved along with the syringe during filling to keep the two together. The position of the plunger may be monitored with optical or pressure sensors. In an alternative embodiment, when the cap is removed, it is held at a cap removal and recapping location, while the syringes are moved to a filling location. After filling, the syringes will be returned to the uncapping/capping location so that the caps may be reapplied.

U.S. Pat. No. 6,729,366 discloses a plurality of fill nozzles for containers having flow meters. Air pressure in a tank of fluid is adjusted based on the output of the flow meters to maintain constant fluid flow. A valve for each nozzle is shut off when the flow meter indicates that the proper fill level is reached.

U.S. Pat. No. 6,530,402 discloses a container filling machine having a plurality of filling pipes, each of which has an electronic flow meter controlling a valve for shutting off fluid flow at the appropriate time.

U.S. Pat. No. 5,129,212 discloses the automatic sterilizing and filling of containers. Sterilization is performed by gaseous hydrogen peroxide or irradiation. Once the containers, which in this case are flexible capped bags, are sterilized, the cap is removed. The bag is filled with the desired contents, and the bag spout is recapped. A cap detector assembly prevents filling of the container if the pressure of the cap is not detected in the cap holder.

U.S. Patent Application No. 2003/0041560 discloses a rotary capping system for regulating the torque applied to screw-on type caps. The system uses an inflatable chuck controlled by a closed loop feedback control system wherein a computer controls a servomotor to apply torque until the desired torque is reached.

U.S. Pat. No. 5,016,688 describes a system for emptying, cleaning, filling, and recapping roller bottles. The bottles are decapped, tilted to empty their contents, and then turned upright. A cleaning liquid is introduced, and the bottles are then tilted to empty the cleaning liquid from the bottles. The bottles are again turned upright, filled with an appropriate medium for cultures and $CO_2$, and capped.

U.S. Pat. No. 4,804,024 discloses an apparatus for filling containers. The apparatus includes a first work station for unscrewing the caps of the containers, a second work station for filling of the containers, and a third work station for reapplying the screw-on caps to the containers.

U.S. Pat. No. 4,761,936 discloses a system for emptying, cleaning, and filling bottles with a culture medium. The bottle is first decapped, and the liquid is sucked therefrom. The bottle is next filled with a cleaning liquid and rolled horizontally with the cleaning liquid therein. The cleaning liquid is then sucked from the bottle. Culture medium is supplied to the bottle, and the bottle is recapped.

U.S. Pat. No. 4,535,583 discloses a capping apparatus. Containers to be capped are mounted on a turntable. A capping head assembly includes a plurality of cap holders, with each cap holder corresponding to a container holder on the turntable. Torque is applied to each cap until it has reached a predetermined level.

U.S. Pat. No. 4,401,141 discloses a container filling machine. The machine includes a flow meter generating signals indicative of the amount of fluid flow through a line leading to a nozzle for filling the container. The signals from the flow meter are counted, and the feed line is shut off when a predetermined number of counts is reached.

U.S. Pat. No. 4,004,620 discloses a container filling system using a feed screw shaped to fit the containers to transport the containers into position under the filling nozzles. The number of rotations of feed screw are monitored to track the position of the container. A photoelectric gate mechanism detects the presence of containers to ensure that containers are present before filling begins. The nozzles are mounted on a walking beam arrangement so that the fill nozzles move with the containers as the containers are being filled.

U.S. Pat. No. 3,870,175 discloses a method of decapping and emptying beer bottles. The method includes the use of a sensor to ensure that the cap is removed.

None of the above references is seen as providing the advantages of a minimized member of components within each feed line, signified design, for the resulting decreased opportunity for bacteria or viruses to enter the system. Furthermore, the above references are not seen as providing the precise filling and capping control of the present invention. Accordingly, there is a need for an improved apparatus for the sterile filling of containers having simplified design, improved precision, and improved sterility.

SUMMARY OF THE INVENTION

The present invention provides an improved apparatus and method for the sterile filling of containers.

The containers, which will typically be bottles with screw caps, are provided to the machine with their caps on, thereby minimizing the opportunity for bacteria to enter the containers. The containers may have been sterilized, possibly by gamma radiation, prior to being supplied to the apparatus. The container loading station is preferably enclosed in an enclosure structured to resist the passage of unfiltered air therein.

Each row of containers is taken from the bottle loading station and passed through a sterilization tube, wherein the containers are sterilized, for example, using ultraviolet radiation. Containers are released from the sterilization tube in batches equal to the number of containers to be filled by one filling cycle of the apparatus.

On exiting the ultraviolet sterilization tube, the containers pass into a second substantially controlled environment, containing capping/uncapping and filling workstations therein. Containers are moved between a pair of feed screws, with the threads of the feed screws dimensioned and configured to hold a container therein, so the turning of the feed screws will control the movement and positioning of the containers. Upon reaching the capping/uncapping and filling stations, the movement of the containers will be secured between a brace fitting between the lead screw and the conveyor upon which the bottles rest, and a plate. The brace defines depressions therein that are structured to receive the bottles. The movement of the brace and plate are controlled by a lateral screw drive mechanism.

The capping/uncapping workstation includes a plurality of rotating grippers, structured to grip the caps of the bottles. The jaws of the grippers secure the caps therein, and then the grippers rotate until the caps are removed from the bottles. After the grippers are raised, the lateral screw drive system moves the bottles from the capping station to the filling station, the filling workstation.

The filling workstation includes a filling system corresponding to each of the containers. Each filling system includes a fluid feed line extending from a fluid source to a filling needle that is structured to be inserted into the top of the bottle. The fluid line passes through a flow meter that is operatively connected through a programmable logic controller to a valve. All containers are filled simultaneously, however, the programmable logic controller for each filling line will shut off the fluid flow into that container using the valve upon the proper amount of fluid flowing through the flow meter, so that the filling of each container is individually and precisely controlled.

After filling, the containers are moved back to the capping station, where the caps have been maintained within the grippers. The grippers are lowered to place the caps on the containers, and then rotated until each of the caps has been applied to the correct torque. Individual torque measurement and control of each gripper insures that each cap is correctly and precisely applied with the correct torque.

After the caps are reapplied, the containers are taken out of the enclosure and moved through a vision inspection system. Rejected containers are removed at a reject station.

The system includes a clean-in-place system that will be used to ensure a clean and sterile path for the fluid at the start of a filling process, or when the fluid or container size is changed. The system includes a drain having a plurality of apertures structured to receive the filling needles, along with the appropriate programmable logic controls. Upon actuation of the system, the needles will be lowered into the drain, a cleaner such as bleach will be passed through the filling needles, and steam will then be passed through the filling needles.

The entire system minimizes the likelihood of bacteria entering the containers during the filling process. Because the containers are sterilized immediately before filling, they enter the enclosure with no bacteria in or on them. Because the caps are removed from the containers only immediately before filling, and replaced immediately after filling, with the filling done in a substantially controlled environment, opportunity for bacteria to enter the containers is again minimized. The use of filling lines with a minimum number of mechanical parts, for example, the diaphragm valve, again minimizes the opportunity for bacteria to enter the system. Minimized human intervention in the filling process further reduces the potential for contamination.

Accordingly, it is an object of the present invention to provide apparatus for filing containers providing greater sterility than is provided by other presently available container filling systems.

It is another object of the invention to provide a method of filling sterile containers that provides greater sterility than other methods.

It is a further object of the invention to provide an apparatus and method for the sterile filling of containers that minimizes the length of time for which a cap is removed from the container.

It is another object of the invention to provide a method of sterile filling containers that sterilizes the containers immediately before filling.

It is a further object of the invention to provide a method of sterile filling of containers wherein each filling line includes a minimum number of mechanical components, thereby enhancing efficiency while also minimizing the opportunity for contamination of the contents of the containers.

It is another object of the invention to provide an apparatus and method for sterile filling wherein volume of fluid dispensed to each container is individually controlled so that each container receives the correct amount of fluid despite any variation in flow rates.

It is a further object of the invention to provide an apparatus and method for sterile filling of containers wherein the torque applied to each cap during capping is individually controlled to ensure that proper torque is applied to each cap.

It is another object of the invention to provide a method of sterile filling containers having a vision inspection to avoid problems during the filling process and provide a means of inspection after filling.

It is a further object of the invention to provide a clean and sterile path for the fluid with which the containers are being filled.

These and other objects of the invention will become more apparent through the following description and drawings.

BRIEF DESCRIPTION OF THE DRAWINGS

Like reference characters denote like elements throughout the drawing.

DESCRIPTION OF THE PREFERRED EMBODIMENTS

Figure 1:
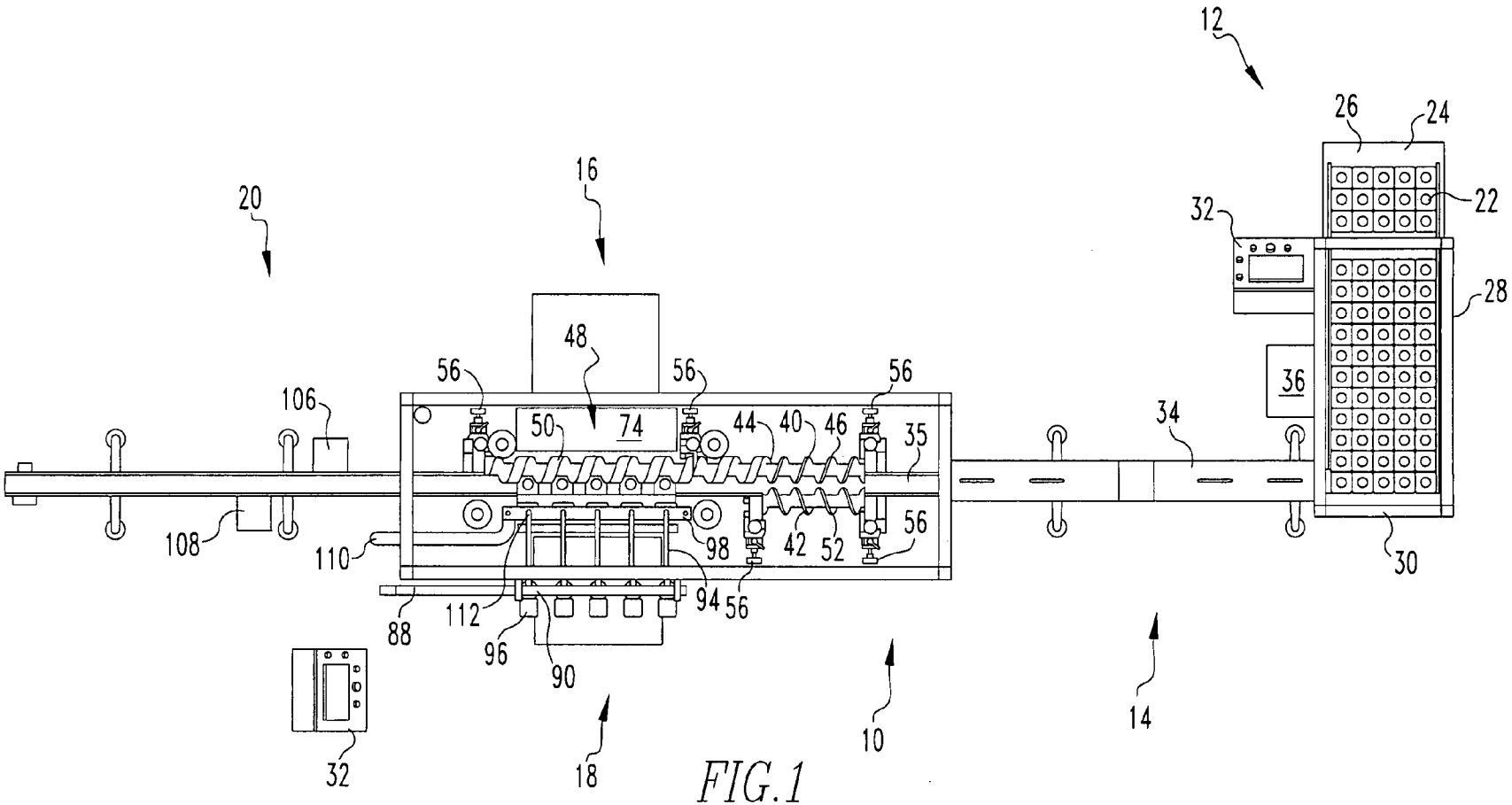
FIG. 1 is a top view of an apparatus for sterile filling of containers according to the present invention.
Figure 2:
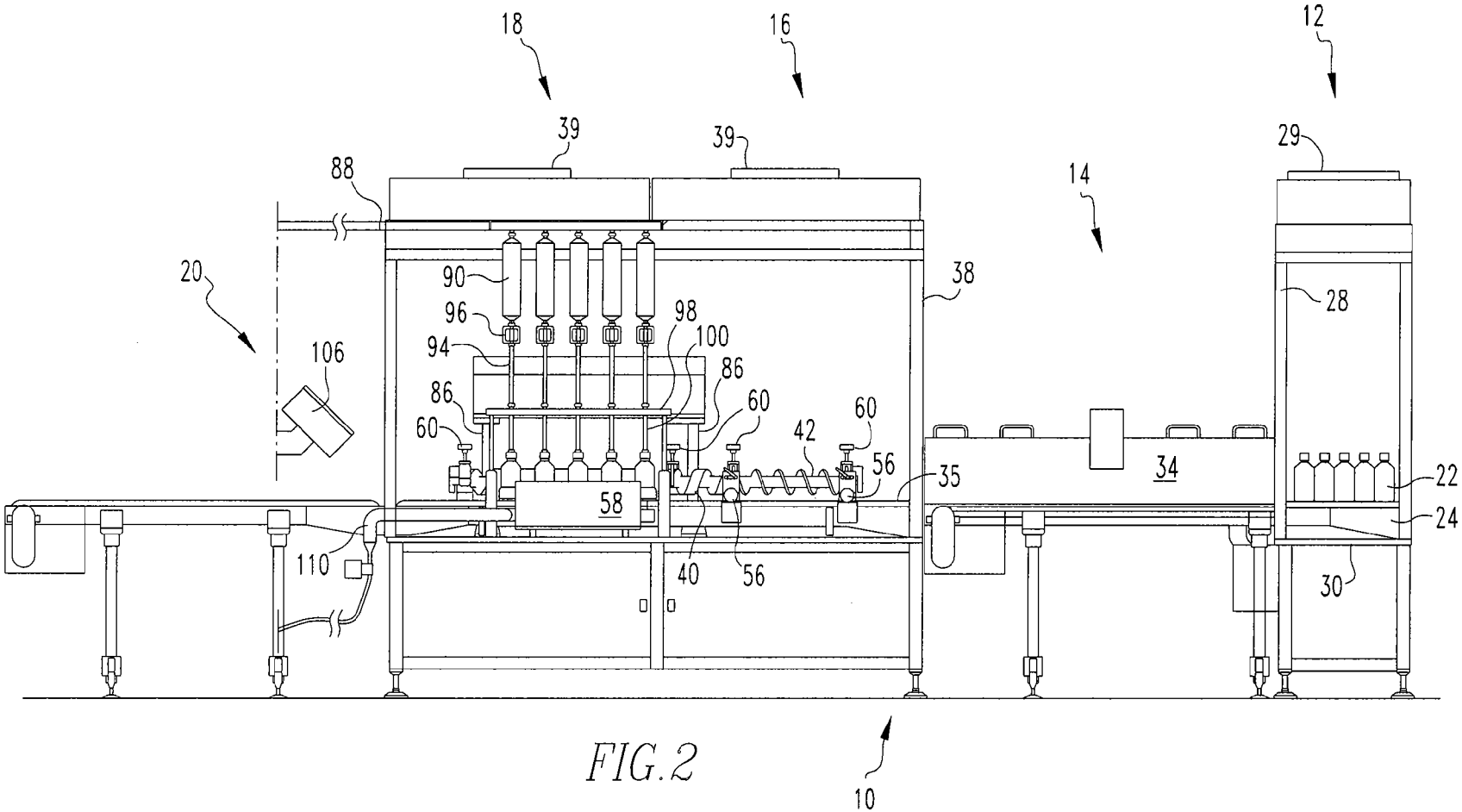
FIG. 2 is a side view of an apparatus for sterile filling of containers according to the present invention.

The present invention provides an improved apparatus and method for the sterile filling of containers. Referring to FIGS. 1-2, the apparatus 10 includes a container loading station 12, a sterilization tunnel 14, a capping/uncapping station 16, a filling station 18, and an inspection system 20.

Figure 3:
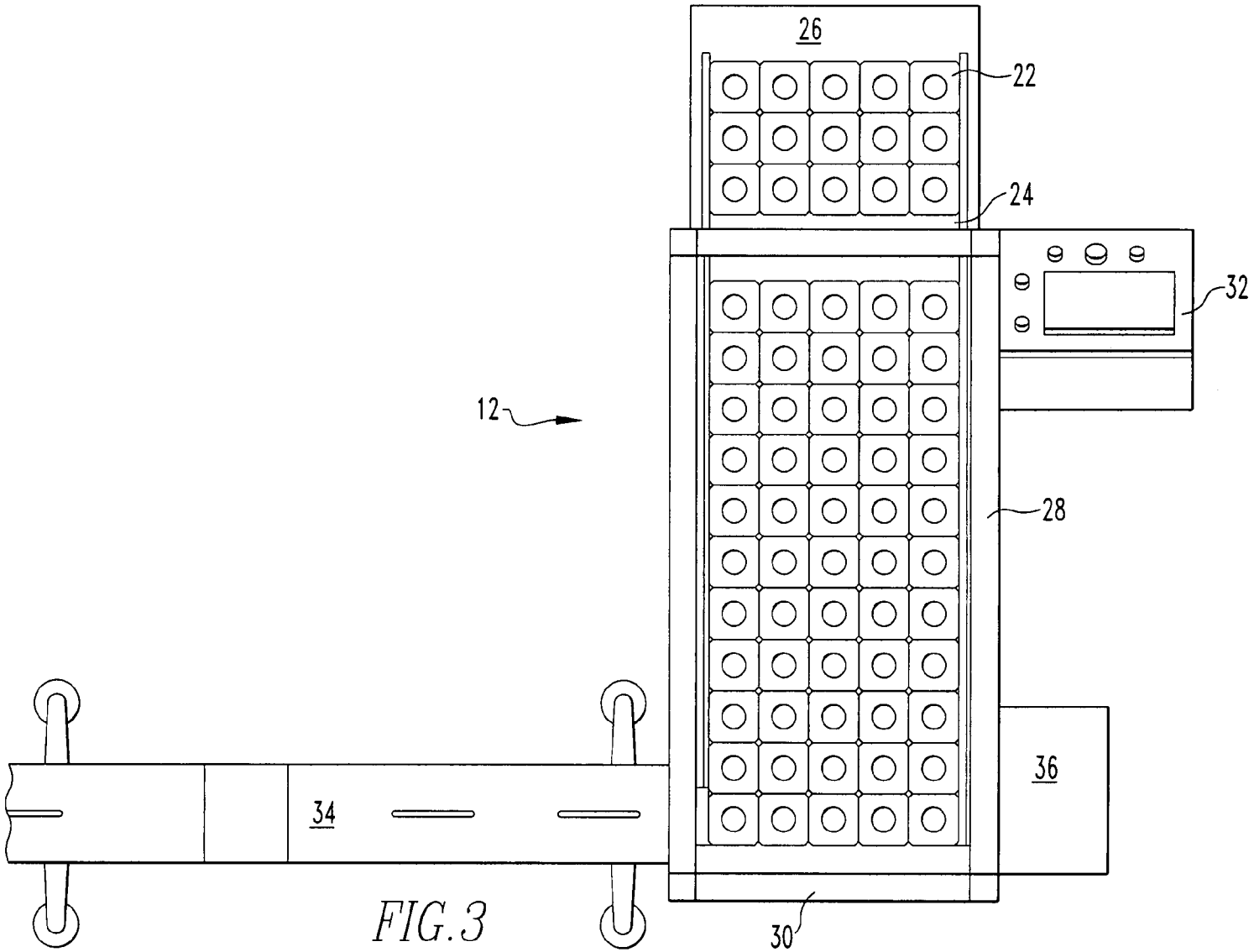
FIG. 3 is a top view of a container loading station for an apparatus for sterile filling of containers according to the present invention.

The container loading station 12, best illustrated in FIG. 3 supports a plurality of rows of containers 22 on a conveyor 24. Containers 22 are loaded onto the conveyor 24 at its first end 26, and are then transported into a loading station enclosure 28, which is structured to resist the entrance of unfiltered air therein. The enclosure includes a filtered air intake 29, which maintains a higher pressure of filtered air within the enclosure to resist the entrance of unfiltered air. The opposite end 30 of the conveyor 24 is in communication with the sterilization tunnel 14, which is substantially parallel to the rows of containers 22 to facilitate the feeding of a row of containers 22 therein. An operator control panel 32 may be utilized with the container loading station 12. The operator control panel 32 permits an operator to control the programmable logic controller, microprocessor, or computer that in turn controls the feeding of containers 22 into the sterilization tunnel 14.

The sterilization tunnel 14 includes a tunnel enclosure 34 having a conveyor 35 passing therethrough, and which is structured to permit the sterilization of containers passing therethrough, for example, by including ultraviolet light source therein (not shown and well known in the art). The electronics for the sterilization tunnel 14, which are well known in the art and therefore not shown, are housed in the enclosure 36. Containers 22 are released from the sterilization tunnel 14 in batches equal to the number of containers to be filled during a filling cycle, which in the illustrated example is five containers.

Figure 6:
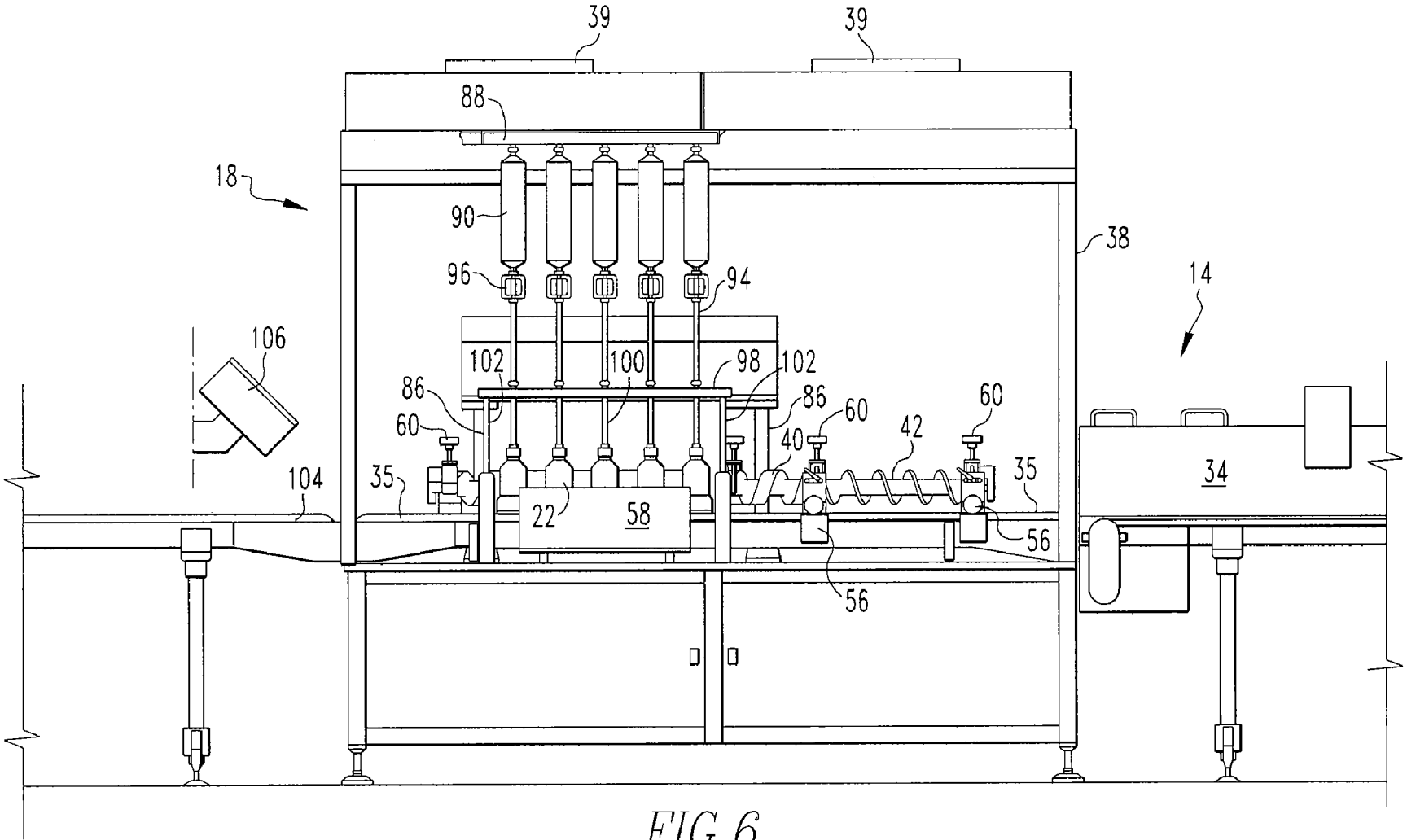
FIG. 6 is a side view of a filling station for an apparatus for sterile filling of containers according to the present invention.

Referring to FIGS. 1, 2, and 6, the opposite end of the sterilization tunnel 14 is in communication with a workstation enclosure 38, having a filtered air intake 39, which is structured to resist the entrance of unfiltered air therein, and to enclose the capping/uncapping station 16 and filling station 18. After entering the enclosure 38, the containers are separated by the lead screws 40, 42, with the containers 22 fitting between these screws and being restrained by the threads on these screws. The longer lead screw 40 includes a first section 44 having narrow threads 46, and a second section 48, adjacent to the capping/uncapping station 16 and filling station 18, having wider threads 50. The second, shorter lead screw 42 includes narrow threads 52 corresponding to the threads 46 within the first section 44 of the lead screw 40. As the conveyor 35 takes the containers between the lead screws 40, 42, the containers will fit between the threads 46, 52, so that the containers will be separated by the threads 46, 52, and controlled by the movement of the lead screws 40, 42 instead of by the movement of the constantly moving conveyor 35. Once the containers have reached the end of the lead screw 42, their movement is controlled solely by the movement of the lead screw 40. Therefore, once the lead screw 40 has moved the containers 22 into the capping/uncapping station 16 and filling station 18, the containers are held in place by the lead screw, and are held at the proper spacing by the threads 50. The lead screws 40, 42 may be changed to accommodate different size containers 22 by opening the levers 60, removing the lead screws 40, 42, substituting lead screws 40, 42 of a different size, and then closing the levers 60. A brace is provided below the lead screw 40, above the conveyor 35, with the brace defining a plurality of depressions structured to receive the containers 22. A plate 58 is disposed on the opposing side of the containers 22, so that when the lead screw 40 has properly positioned the containers 22 and the brace is moved against the containers 22, the containers are secured between the brace and the plate 58. The lateral movement of the brace and the plate 58 between the capping/uncapping station 16 and filling station 18 is controlled by the lateral drive screw mechanism 56.

Figure 4:
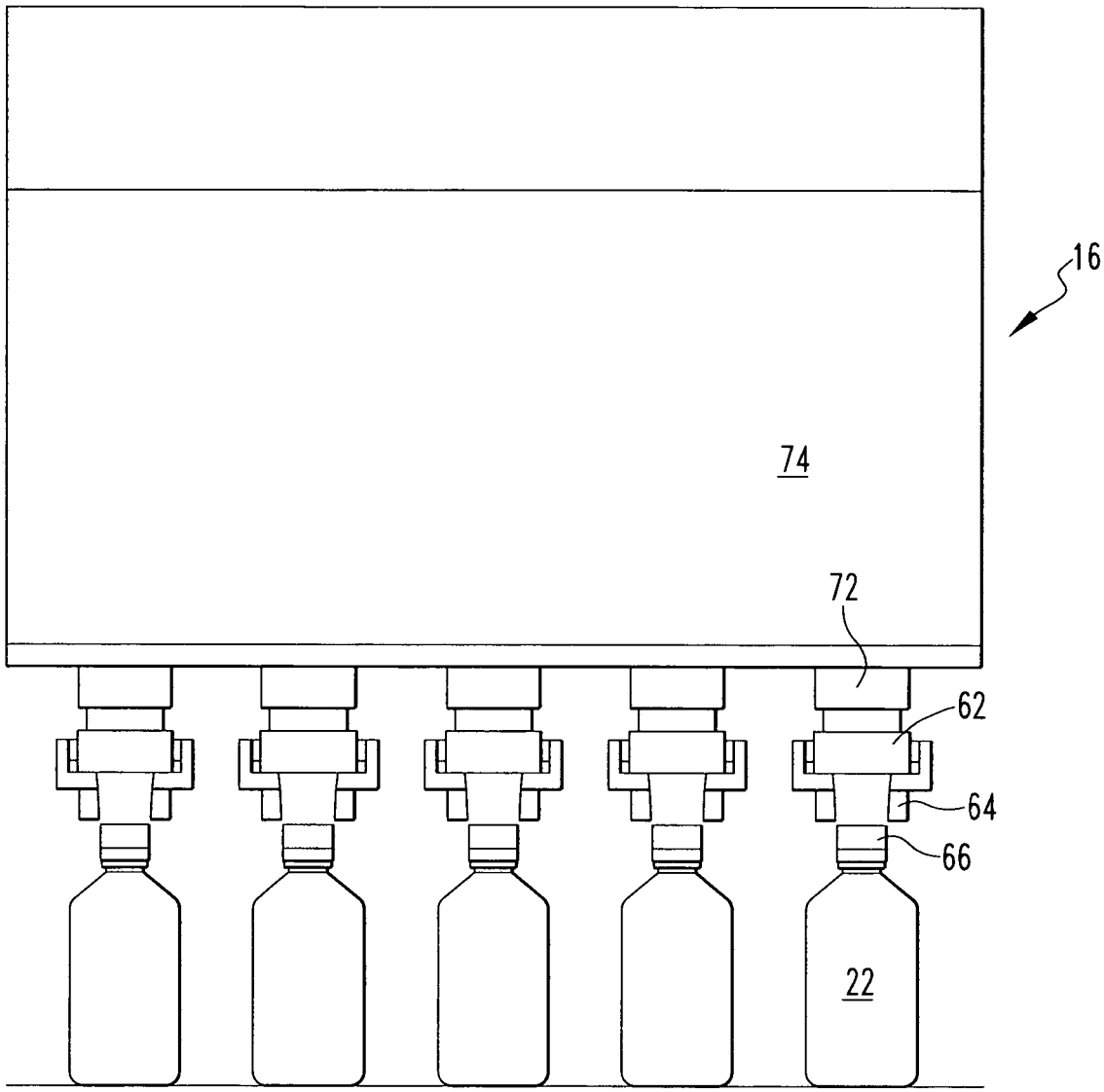
FIG. 4 is a side view of a capping and uncapping station for an apparatus for sterile filling of containers according to the present invention.
Figure 5:
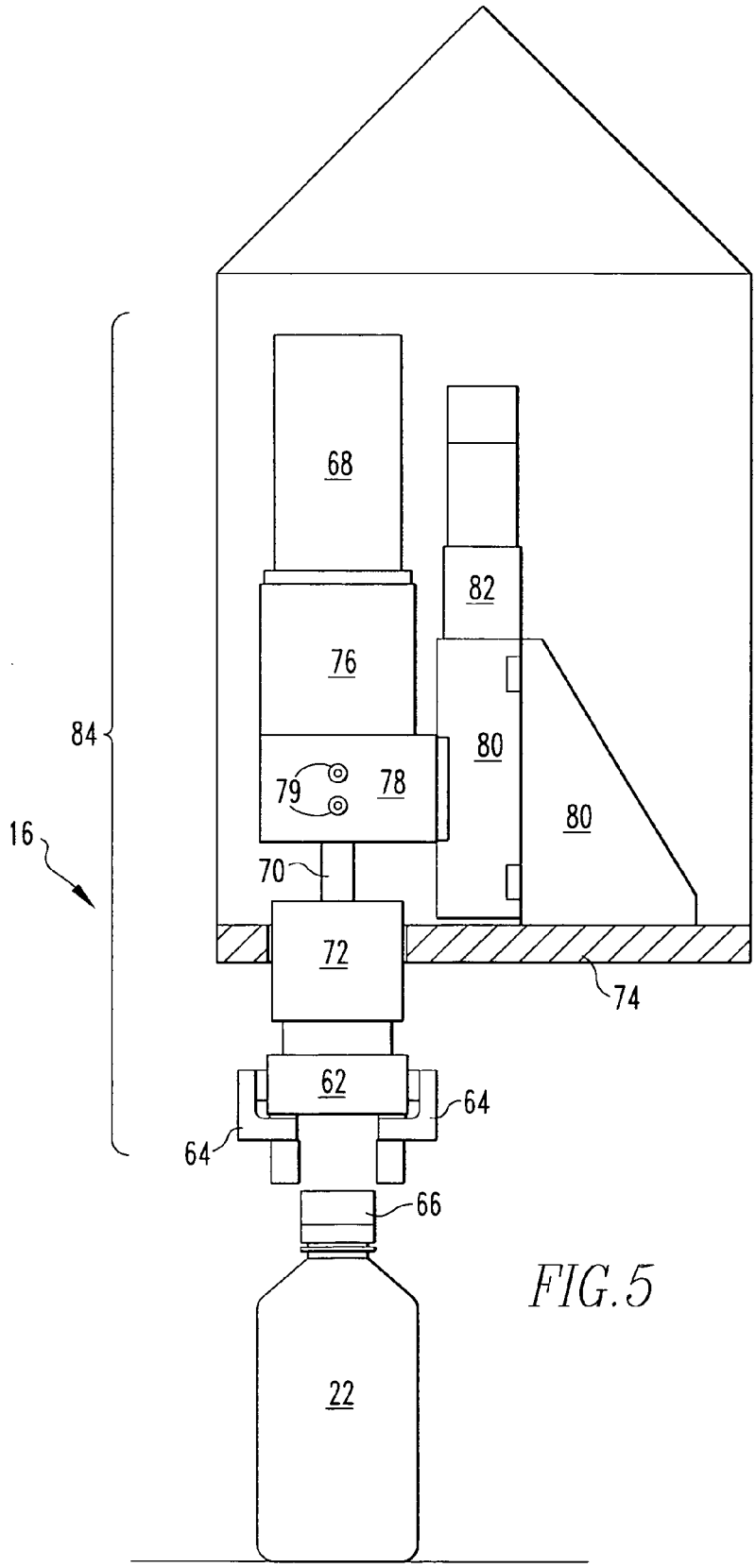
FIG. 5 is an end view of a capping and uncapping station for an apparatus and method for sterile filling of containers according to the present invention.
Figure 7:
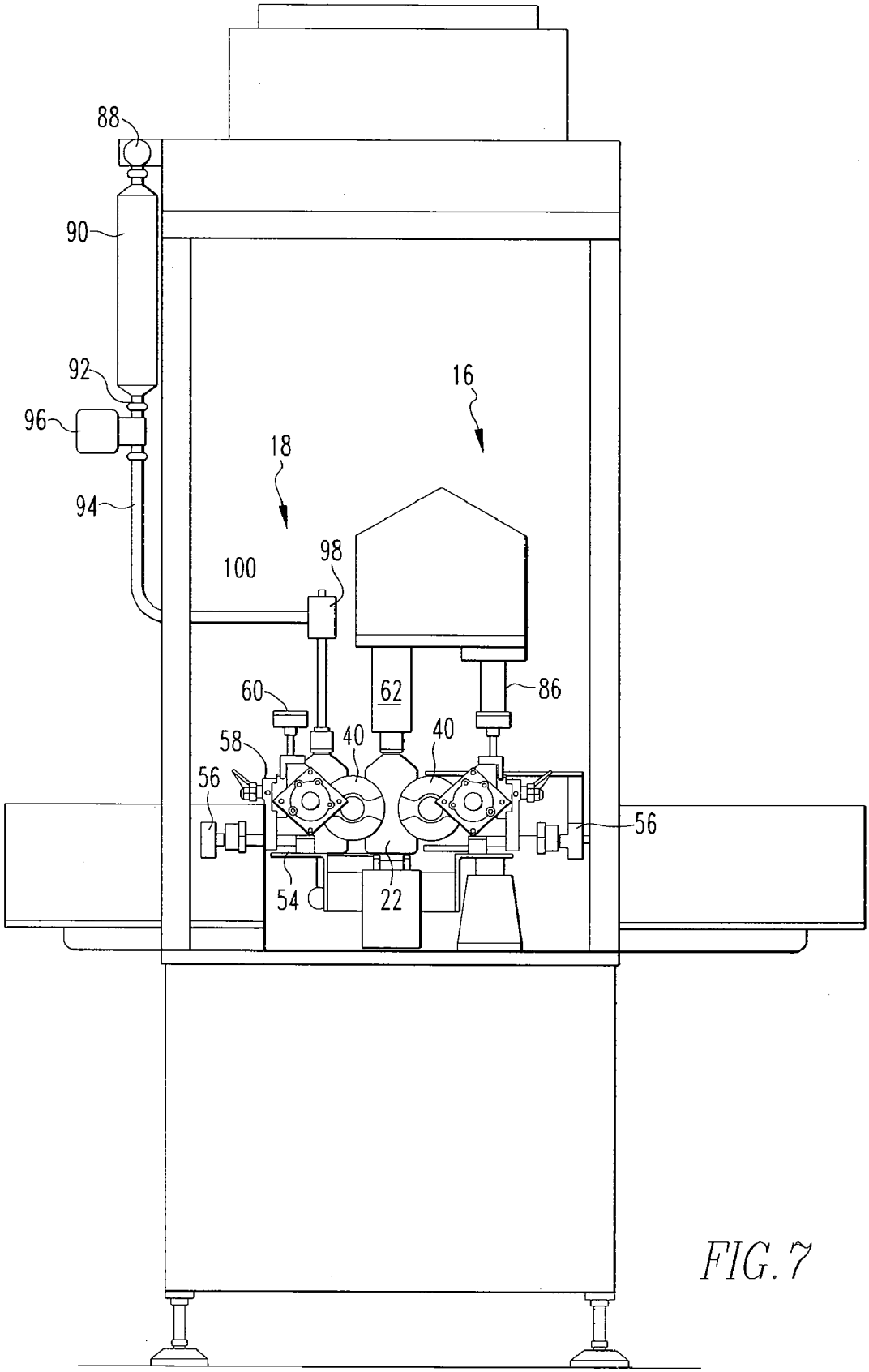
FIG. 7 is an end view of a filling station for an apparatus for sterile filling of containers according to the present invention.

The capping/uncapping station 16 is best illustrated in FIGS. 4-5. The capping/uncapping station 16 includes a plurality of rotating grippers 62, each having jaws 64 structured to grip a cap 66 of a container 22. Each of the rotating grippers 62 is controlled by an individual servo motor 68. The motor 68 is operatively connected to the gripper 62 by the drive shaft 70, having a wider section 72 that passes through an opening within the housing 74. The servo motor 68 requires an amount of electrical current that is directly proportional to the torque applied by the motor 68 to the cap 66. Therefore, the amount of current drawn by the motor 68 provides a measure of the torque applied by the motor 68, and the motor 68 may be stopped when the measured current reaches the amount corresponding to the desired torque. The motor 68 is mounted on the mount 76, which is mounted to the rotary union 78. The rotary union 78 is secured to a linear slide 80 that is slidably mounted on a support bracket 81. Raising and lowering of the linear slide 80 is controlled by motor 82, thereby permitting the entire motor driven cap removal assembly 84 to be raised upward to lift the cap 66 away from the container 22, and to be lowered to bring the cap 66 into engagement with the container 22. The rotary union 78 defines a pair of air intakes 79, through which air may be directed into the assembly 84 by an air compressor system (not shown and well-known in the art) and against the jaws 64, so that air pressure may push the jaws open or closed as needed, in a manner well-known in the art of mechanical jaws. The actuation of the air compressor system is controlled by an appropriate programmable logic controller, microprocessor, or computer. Referring to FIGS. 2 and 7, the housing 74 is mounted on a pair of adjustable legs 86, thereby permitting the height of the housing 74 to be adjusted to accommodate containers 22 of varying heights.

The filling station 18 is best illustrated in FIGS. 2, 6, and 7. The filling station 18 includes a fluid supply line 88 in communication with a plurality of flow meters 90, which are five in number in the illustrated embodiment. The exit end 92 of each flow meter 90 is secured to a flexible hose 94 passing through a pinch valve 96. The amount of fluid passing through the flow meter 90 is provided as a signal to a microprocessor, programmable logic controller, or computer, which sends a signal to close the pinch valve 96 upon a predetermined amount of fluid passing through the flow meter 90. The hose 94 terminates at the bracket 98, wherein it connects with the filling needle 100. The bracket 98 is mounted on a pair of extendible legs 102, which may in some embodiments take the form of a hydraulic cylinder, thereby permitting the bracket 98, and therefore the filling needle 100, to be raised and lowered. In some embodiments, the filling needle 100 will be equipped with a second valve, thereby preventing any excess drip into the containers 22 after the pinch valve 96 is closed. Some embodiments may also include a photoelectric system to ensure that each cap has been removed from each bottle before the filling needles are lowered into the bottles. If the beam passing over the top of the container 22 is broken by the presence of the cap 66, the photoelectric receiver will not receive the beam transmitted by the opposing photoelectric transmitter, so that the programmable logic controller or other controller that controls the filling process may be signaled to stop the filling process.

The conveyor 35 terminates at the exit end of the enclosure 38, adjacent to a transfer plate (not shown) and a second conveyor 104. Air is drawn into the enclosure 38 through the filtered air intakes 39 at sufficient pressure to insure that, when the enclosure 38 is open to permit the container 22 to exit, air flows from inside the enclosure 38 to the outside, thereby resisting the entrance of unfiltered air into the enclosure. The containers 22 are then taken through a vision inspection system 106, where the containers are checked for fill volume and cap placement. Any containers showing indications of problems are pushed to the reject station 108 by a solenoid-actuated punch.

The apparatus 10 includes a clean-in-place system having a drain 110 which is located within the enclosure 38 underneath the filling needles 100, and defines a plurality of holes 112 therein, with each hole 112 being structured to receive one of the filling needle 100. The system may also include microprocessor-controlled cleaning, whereby a cleaning fluid and/or steam may be automatically passed through the filling needles 100 to the drain 110 by actuation of the appropriate controls of a control panel 32.

The entire process of filling containers may be controlled by a microprocessor, programmable logic controller, and/or computer. Containers that have been loaded into the enclosure 28 will be released onto the conveyor 35 from the container 28 one row at a time. The containers will be sterilized as they pass through the sterilization tunnel 14, possibly using ultraviolet radiation. Upon exiting the sterilization tunnel 34, they will enter the enclosure 38, entering the space between the lead screws 40, 42. The lead screws 40, 42 will separate the containers 22, and will accurately position them for the capping/uncapping operation and the filling operation. The assembly 84 will be lowered by the motor 82, with air pressure holding the jaws 64 open, until the jaws are on opposing sides of the cap 66. Air pressure will then be released and the jaws 64 allowed to close under spring pressure around the cap 66. The motor 68 will then rotate the cap 66 until it has been disengaged from the threads of the container 22, and the motor assembly 84 and linear slide 80 will be raised upward by the motor 82. The lateral screw drive mechanism 56 will then move the platform 54 so that the containers 22 are moved from the capping/uncapping station 16 to the filling station 18. The legs 102 will be retracted so that the filling needles 100 are lowered into the container 22, stopping at a position near the bottom of the container 22. Fluid will then be injected into the container 22, with the needles 100 being raised to maintain a position just above the surface of the liquid within the container 22, until the proper quantity of fluid has passed through the flow meter 90, at which point the pinch valve 96 will receive the appropriate signal from the programmable logic controller and cut off further fluid flow. The legs 102 will extend, raising the bracket 98, raising the filling needle 100 out of the container 22. The lateral screw drive mechanism 56 will then move the platform 54 in the opposite direction, thereby positioning the containers under the capping/uncapping station 16. The linear slide motor 82 will lower the linear slide 80 and the assembly 84 to place the cap 66 back on the container 22, and the motor 68 will then rotate the gripper 62 until the current required to operate the motor 68 is at a sufficient level to indicate that the proper torque has been reached. Air pressure will then be drawn into the mechanism to force the jaws 64 away from the cap 66, and the assembly 84 will again be raised away from the container 22. The container 22 will then exit the enclosure 38 and proceed to inspection.

When it is desired to begin filling containers with a different liquid, the apparatus 10 may be cleaned using the clean in place system. With the needle 100 lowered into the hole 112, a cleaner, for example, bleach, may be pumped through the system, followed by steam, which may in some preferred embodiments be at a pressure of about 25 p.s.i. and a temperature of about 125° C. The programmable logic controller may be programmed using techniques well known to those skilled in the art to perform the cleaning function in response to the push of a single button on the control panel.

From the above description, it will be apparent that the apparatus and method of the present invention is capable of filling containers with unparalled sterility. The containers are initially stored within the enclosure 28, which resists the entrance of unfiltered air by maintaining a positive air pressure of filtered air. The container 22 are taken directly from the loading station enclosure 28 to a sterilization tunnel 34, where they are sterilized and then immediately moved to the enclosure 38 without contact with the outside air. The enclosure 38 again maintains a positive pressure of filtered air to resist the entrance of unfiltered outside air. Because the caps have remained on the bottles up until this point, any bacteria or viruses that may have entered the enclosure 38 have a minimized likelihood of entering the container 22. Upon the removal of the cap 66 from the container 22, the containers are moved to the filling station, filled, and moved back to the capping/uncapping station to have their caps replaced, so that some preferred embodiments leave the containers 22 uncapped for only about ten seconds or a similarly short time period. The fluid lines are designed with a minimum of mechanical parts, thereby minimizing the number of openings through which bacteria or viruses may enter. As the containers exit the enclosure 38, a positive pressure of filtered air is maintained to resist the entrance of unfiltered air. The need for human contact with the apparatus and the resulting potential for contamination has been minimized.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

The invention claimed is:

1. An apparatus for sterile filling of containers, each container having a cap, the apparatus comprising:

a sterilization apparatus;

a workstation enclosure in communication with the sterilization apparatus, the enclosure being structured to resist entry of unfiltered air into the workstation enclosure;

a capping and uncapping workstation within the workstation enclosure;

a filling workstation within the workstation enclosure;

a pair of feed screws having threads structured to receive a plurality of containers therebetween, at least one of the feed screws being further structured to position the containers under the capping and uncapping workstation; and a drive mechanism for moving the containers between the capping and uncapping workstation and the filling workstation.

2. The apparatus according to claim 1, wherein the capping and uncapping workstation further includes:

at least one rotating gripper structured to grip the cap therein, to rotate in a first direction to remove the cap, and to rotate in a second direction to secure the cap to the container; and means for raising and lowering the gripper.

3. The apparatus according to claim 2, wherein the gripper further includes at least a pair of jaws structured to move between an open position and a closed position wherein the pair of jaws are positioned to grip a cap of a container.

4. The apparatus according to claim 3, wherein the jaws are opened and closed by air pressure.

5. The apparatus according to claim 2, wherein the means for raising and lowering the gripper include a motor operatively connected to a linear slide to which the gripper is mounted.

6. The apparatus according to claim 2, further comprising:

means for measuring torque associated with the rotating gripper; and a programmable logic controller, microprocessor, or computer for controlling rotation of the rotating gripper, and for stopping rotation of the rotating gripper upon the torque reaching a predetermined amount.

7. The apparatus according to claim 6, wherein the means for measuring torque associated with the rotating gripper include a servo motor operatively connected to the gripper, and a current sensor structured to measure current drawn by the servo motor.

8. The apparatus according to claim 1, wherein the filling workstation further includes:

a filling system for each container, each filling system comprising:

a fluid path from a source to a filling needle structured for insertion into the container;

a flow meter disposed along the fluid path;

a valve structured to resist fluid flow; and a programmable logic controller, microprocessor, or computer structured to receive fluid flow information from the flow meter and to close the valve upon the passage of a predetermined amount of fluid through the flow meter.

9. The apparatus according to claim 8, wherein each valve of the filling system is a pinch valve.

10. The apparatus according to claim 8, further comprising a vision system structured to verify that each container being filled is uncapped.

11. The apparatus according to claim 8, further comprising a clean-in-place system.

12. The apparatus according to claim 11, wherein the clean-in-place system includes a drain disposed under the filling needles.

13. The apparatus according to claim 12, wherein the drain includes an aperture structured to receive each of the filling needles.

14. The apparatus according to claim 1, wherein the workstation enclosure includes an air inlet having a filter and structured to maintain a positive pressure of filtered air within the workstation enclosure.

15. The apparatus according to claim 1, further comprising a container loading station structured to feed a predetermined number of containers.

16. The apparatus according to claim 15, wherein the container loading station includes a loading station enclosure that is structured to resist the entry of unfiltered air therein.

17. The apparatus according to claim 16, wherein the loading station enclosure includes an air inlet having a filter and structured to maintain a positive pressure of filtered air within the loading station enclosure.

18. The apparatus according to claim 1, wherein the sterilization apparatus is structured to apply ultraviolet radiation to the containers.

19. The apparatus according to claim 1, further comprising a vision system disposed after the capping and uncapping workstation and the filling workstation, the vision system being structured to inspect the containers after filling.

20. The apparatus according to claim 19, further comprising:

a reject station disposed adjacent to the vision system; and means for moving a container to the reject station upon the container being identified as rejected.

21. A method of sterile filling of containers, comprising:

providing a sterilization apparatus;

providing a workstation enclosure in communication with the sterilization apparatus, the enclosure being structured to resist entry of unfiltered air into the workstation enclosure;

providing a capping and uncapping workstation within the workstation enclosure;

providing a filling workstation within the workstation enclosure;

providing a plurality of containers having caps, with the caps on the containers;

providing a pair of feed screws having threads structured to receive a plurality of containers therebetween, at least one of the feed screws being further structured to position the containers under the capping and uncapping workstation and the filling workstation;

providing a drive mechanism for moving the containers between the capping and uncapping workstation and the filling workstation;

transporting the containers through the sterilization apparatus;

transporting the containers directly from the sterilization apparatus into the workstation enclosure;

removing the caps from the containers;

filling the containers; and replacing the caps on the containers.

22. The method according to claim 21, further comprising maintaining a positive pressure of filtered air within the workstation enclosure.

23. The method according to claim 22, further comprising:

providing a container loading station structured to feed a predetermined number of containers, the container loading station having a loading station enclosure that is structured to resist the entry of unfiltered air therein; and feeding containers into the sterilization apparatus from the container loading station.

24. The method according to claim 21, further comprising individually controlling a torque applied to each cap during capping and uncapping.

25. The method according to claim 21, further comprising individually monitoring and controlling the volume of fluid deposited into each container during filling.

* * * * *